United States Patent [19]

Matson

[11] 4,435,083

[45] Mar. 6, 1984

[54] SELF-CLAMPING ROTARY VIBRATOR AND MOUNT THEREFOR

[75] Inventor: Carl G. Matson, Little Rock, Ark.

[73] Assignee: Hamilton Equipment Co., Inc., Fort Worth, Tex.

[21] Appl. No.: 310,500

[22] Filed: Oct. 13, 1981

[51] Int. Cl.[3] ..... B01F 11/00

[52] U.S. Cl. ..... 366/114; 366/124; 366/126; 366/128

[58] Field of Search ..... 366/108, 110, 111–116, 366/124–126, 128; 285/394–396; 74/61, 87; 29/DIG. 46; 128/32, 34–37

[56] References Cited

U.S. PATENT DOCUMENTS 3,822,054 7/1974 Matson ..... 366/114

*Primary Examiner*—Timothy F. Simone

*Attorney, Agent, or Firm*—Emrich, Lee, Brown & Hill

[57] ABSTRACT

A rotary vibrator having a cylindrical shape and an outer cam strip running the length thereof is mounted in a housing which has a matching inner cam strip and is affixed to a structure to be vibrated. Vibrator migratory movement during operation causes the vibrator cam strip to engage the adjacent surface of the housing and the housing cam strip to engage the adjacent surface of the vibrator. This wedging effect gives rise to a third point of vibrator-housing contact located essentially equidistant from the other two contact points and displaced therefrom approximately 120°. Thus, a secure inter-locking between the vibrator and its mount is achieved. A source of compressed gas may be attached at either end of the vibrator and an exhaust outlet located in the vibrator directs the pressurized driving fluid into the space between the vibrator and housing for vibrator cleaning and lubrication and for quieter vibrator operation. Vibrator removal from the mount housing is accomplished by means of a vibrator-mounted knock-off lug with vibrator overtightening in the mount housing prevented by a vibrator rotation stop.

11 Claims, 5 Drawing Figures

SELF-CLAMPING ROTARY VIBRATOR AND MOUNT THEREFOR

BACKGROUND OF THE INVENTION

This invention relates generally to rotary vibrators and, more particularly, is directed toward an improved self-clamping vibrator-mounting bracket assembly.

Vibrators are used in various materials-handling applications such as for settling concrete and removing sand from foundry flasks. These applications typically involve large forms or molds wherein the vibrator is intermittently applied to various areas of the material to be agitated. An external vibrator securely mounted to the form or mold is preferred in such applications as internal vibrators are expensive to maintain and difficult to operate without degrading concrete quality and appearance. Ideally, an external vibrator should be relatively small and compact and capable of being securely and easily attached and removed without the use of complicated tools or an intricate and time-consuming procedure.

In addition, it is desirable for the vibrator to be self-locking thus obviating the need for conventional mounting means such as screws which generally must be continually tightened as they are subject to vibration loosening. The ideal rotary vibrator would also be free from the destructive effects of rust, corrosion and dust. In particular, the vibrator should not be susceptible of being contaminated with the material being vibrated which, in the case of concrete, generally results in damage to or destruction of the vibrator. Finally, the vibrator should be of a relatively simple design for increased reliability, ease of manufacture, and moderate cost.

U.S. Pat. No. 3,822,054, issued in the name of the present inventor, discloses a rotary vibrator having a generally tubular mounting structure within which a substantially circular vibrator casing is initially loosely fitted. The interior of the mount has one or more cam surfaces and the exterior of the casing has one or more cooperating cam surfaces. The rotation of the orbiting weight causes the casing in which it is located to undergo a migratory rotative movement in the same direction as that of the orbiting member. The migratory rotative movement of the vibrator's casing produced by the continuing driving force applied to the vibrator rotor causes the cam surfaces, or wedges, to interengage and continuously tighten so long as the driving force is applied. This three cam or deformed housing approach produces a relatively fast wedge or ramp shape. However, the angle of engagement between the casing and the mount is difficult to precisely control due to constant surface wear, flexibility of the housing, and surface distortion resulting from vibrator mounting. In addition, this configuration is not readily conducive to conventional fabrication and manufacturing processes because of the relative intricacy of the engaging surfaces.

SUMMARY OF THE INVENTION

The present invention, in overcoming the aforementioned limitations, provides an improved rotary vibrator and mount therefor which permits the free and easy installation and removal of the vibrator from the mount. This facilitates the relocation of the vibrator from one location to another without the difficulties generally introduced by rust, corrosion, accumulation of material being vibrated, etc. The present invention also provides a simpler and less expensive design offering increased clamping area between surfaces for improved vibrator operation and enhanced reliability.

Briefly, the present invention contemplates a rotary vibrator including a casing wherein is located an orbiting mass or rotor energized by conventional drive means, such as a compressed air system. The rotor casing is inserted in a housing which may be rigidly attached to an object to be vibrated. In a preferred embodiment, the casing is cylindrical and the housing is tubular in shape. The casing includes a cam strip on the outside thereof and initially loosely fits in the housing mount which also has a cam strip located on its inner surface. The rotation of the rotor causes the vibrator casing to rotate in a migratory manner, forcing the casing cam strip into wedging contact with the housing and the housing cam strip into wedging contact with the casing. A third point of contact is established between the housing and the casing, displaced approximately 120° from the two aforementioned contact points.

The drive means may be coupled to either end of the vibrator and easily disconnected therefrom by rotating a knock-off lug in a direction opposite to that of rotor motion. An exhaust outlet is provided in the outer surface of the vibrator casing and is directed into the space between the housing and casing for vibrator cleaning and lubrication. In addition, a rotation stop is included in the housing-casing interspace to prevent over-rotation therebetween in facilitating vibrator removal from the mount.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
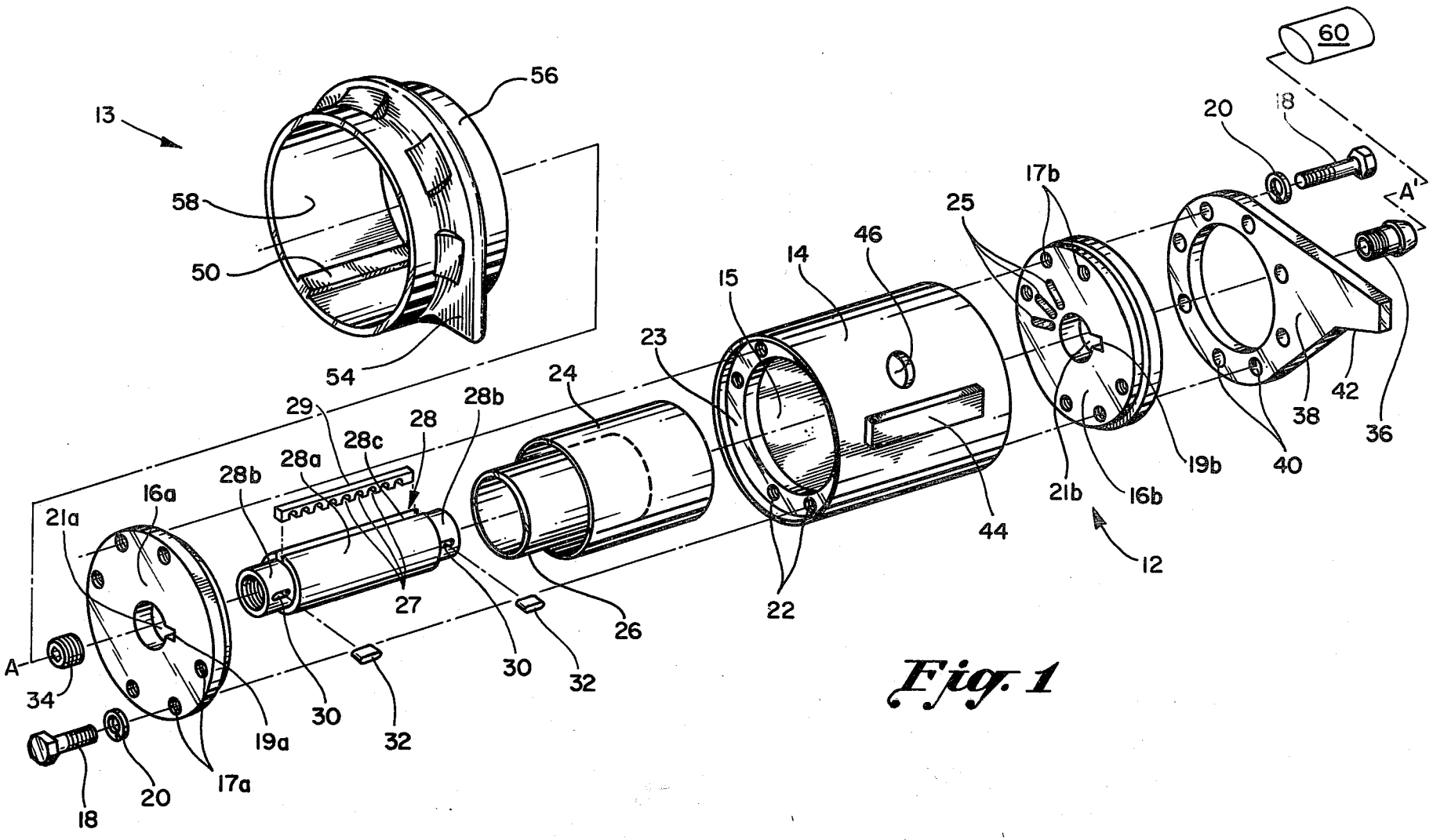
FIG. 1 shows an exploded view of a vibrator assembly and a mounting bracket in accordance with the present invention.

Referring to FIG. 1, there is shown a vibrator assembly 12, in an exploded view, and a mounting bracket 13 in accordance with the self-clamping rotary vibrator and mount therefor of the present invention.

Vibrator assembly 12 includes a generally cylindrically shaped vibrator body 14 having a passageway 15 lengthwise therethrough. Positioned lengthwise in passageway 15 and concentrically with respect to each other are eccentric outer roller 24 and inner roller 26. Positioned lengthwise within inner roller 26 is vibrator shaft 28 having shaft positioning apertures 30 on each end. A shaft key 32 is positioned in each shaft positioning aperture in providing an interlocking mechanism between vibrator shaft 28 and each of the vibrator end caps 16*a* and 16*b*. Thus, the orientation of vibrator shaft 28 is coupled to vibrator end caps 16*a* and 16*b* by means of shaft keys 32 which are inserted in shaft positioning apertures 30 so as to be positioned in end cap key inserts 19*a* and 19*b* in each of the end cap apertures 21*a* and 21*b*, respectively.

Inserted between vibrator shaft 28 and inner roller 26 is vibrator vane 29 which extends the length of vibrator shaft center section 28*a*. The diameter of vibrator shaft center section 28*a* is larger than the diameter of vibrator shaft end sections 28*b* for the stable positioning of vibrator shaft 28 between vibrator end caps 16*a* and 16*b* when vibrator 12 is assembled. Vibrator shaft end sections 28*b* project through end cap apertures 21*a* and 21*b* when vibrator 12 is assembled with shaft positioning apertures 30 aligned with and coupled to end cap key inserts 19*a* and 19*b* by means of shaft keys 32 positioned therein.

Vibrator vane 29 is positioned between inner roller 26 and vibrator shaft 28 which includes slot 28*c* through which the pressurized gas flows. The relationship of vane 29 to inner roller 26 and vibrator shaft 28 is such that pressurized gas flowing in the space therebetween causes the rotation of inner roller 26 and eccentric outer roller 24 which, in combination, may be considered the vibrating element and form a rotor. The vibratory movement of inner and outer rollers 26, 24 about the axis A—A' allows the pressurized gas, which typically is air, entering vibrator body 14 via slot 28*c* in vibrator shaft 28 to be vented therefrom by means of exhaust outlet 46 during alternating cycles of the rotation of inner and outer rollers 26, 24. Exhaust from vibrator body 14 is effected by a plurality of slots 25 on the inner surface of each end cap 16*a*, 16*b* conveying air to the chamber outside of eccentric tube 24 and thence out of exhaust port 46 to the atmosphere.

Vibrator vane 29 is provided with a plurality of slots 27 through which air passing through the slotted portion 28*c* of vibrator shaft center section 28*a* flows. Vibrator vane 29 is thus responsive to a gas, such as air, under pressure within the space defined by the cylinder of vibrator shaft 28. The pressurized air is provided to vibrator shaft 28 by connecting a pneumatic drive system 60 to inlet fitting 36 which is coupled through end cap aperture 21*b* to vibrator shaft end section 28*b*.

For a better appreciation of the cooperative relationships among the various components of vibrator assembly 12, a brief description of the procedure for assembling vibrator assembly 12 is provided. First, the two keys 32 are inserted into positioning apertures 30 of vibrator shaft 28. One end of vibrator shaft 28 is then inserted through end cap aperture 21*a*. The combination of vibrator shaft 28 and end cap 16*a* is then mounted to one end of vibrator body 14. Vane 29 is then inserted between vibrator shaft 28 and inner roller 26 after inner and outer rollers 26, 24 are concentrically positioned thereabout. The internal components of vibrator assembly 12 are then lightly oiled with an air motor lubricant and end cap 16*b* is then attached to the other end of vibrator body 14. The two end caps 16*a*, 16*b* and knock-off lug 38 are then firmly attached to vibrator body 14 by means of mounting bolts 18 and lock washers 20. Pipe plug 34 is then attached to one end of vibrator shaft 28 and inlet fitting 36 is attached to the other end of vibrator shaft 28.

Figure 2:
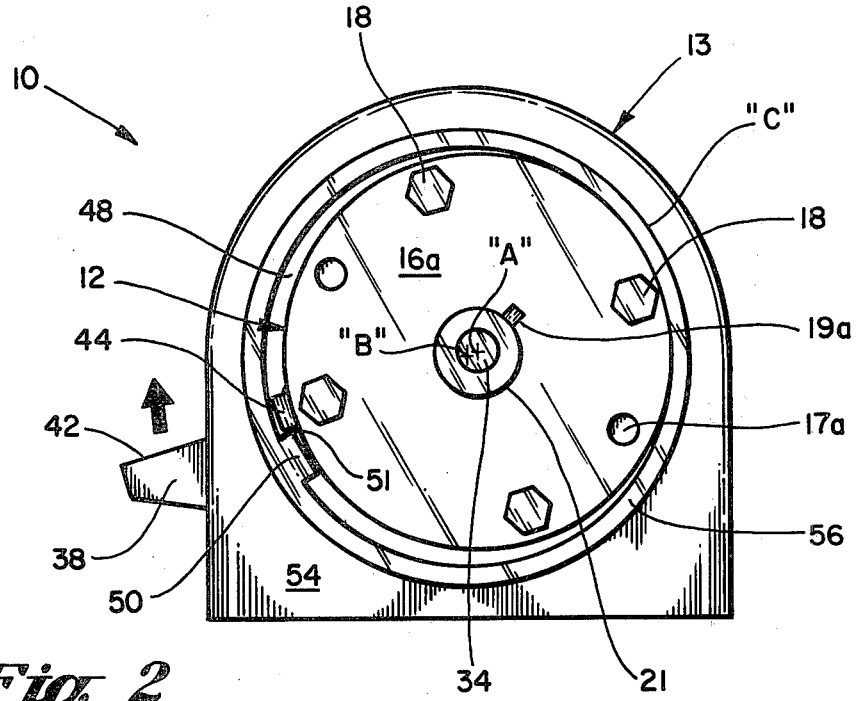
FIGS. 2–4 show an end view of the self-clamping rotary vibrator and mount of the present invention in which the rotation of the vibrator assembly in the mounting bracket to achieve the self-clamping effect is shown in sequence.
Figure 3:
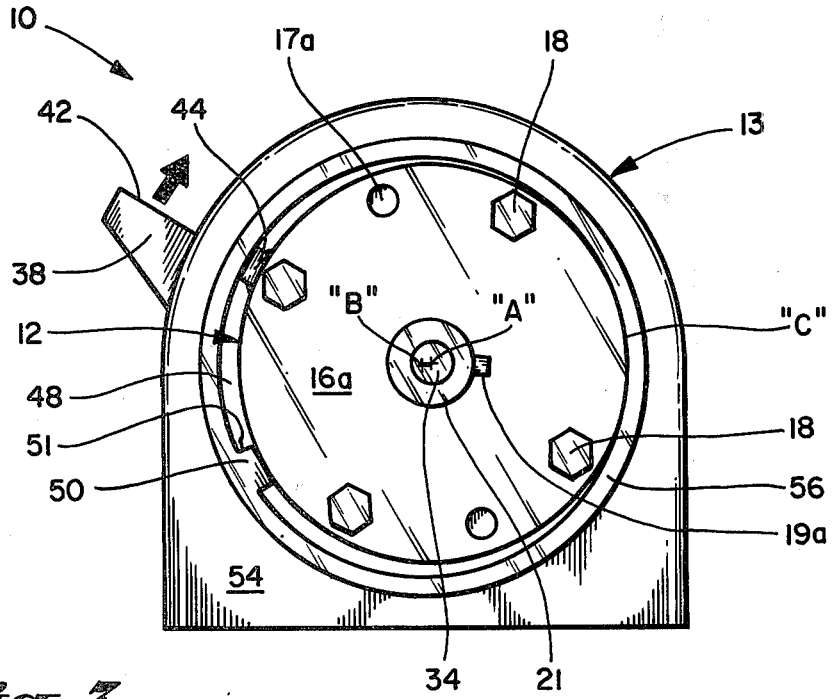
Figure 4:
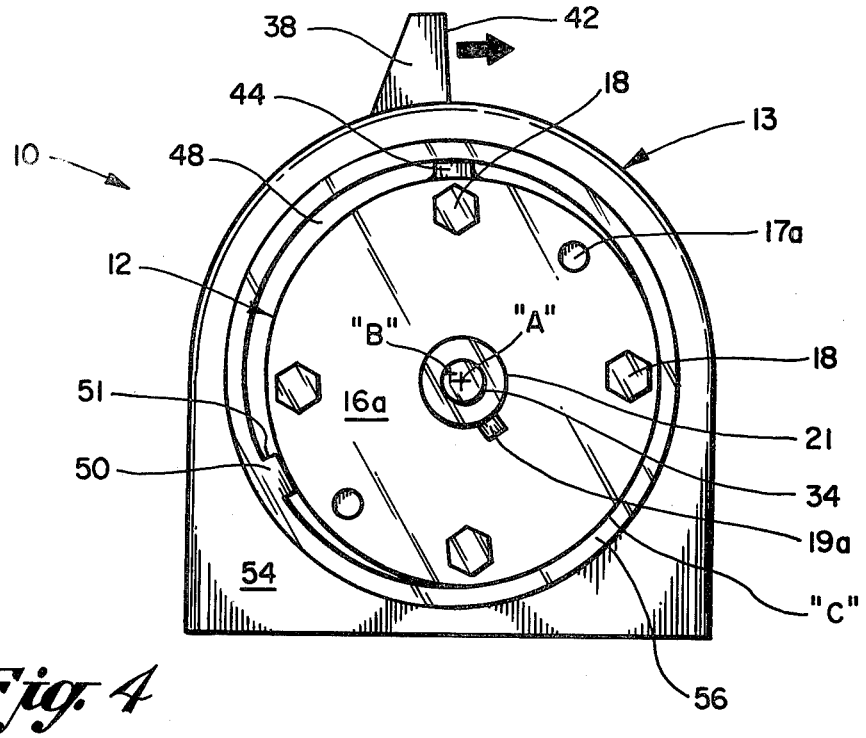

Following the insertion of vibrator assembly 12 in mounting bracket 13, the user gives vibrator assembly 12 a slight turn (here clockwise) as shown in FIGS. 2–4. Knock-off lug 38 provides the user with a convenient handle for rotating and initially securing vibrator assembly 12 in mounting bracket 13. Manual rotation of vibrator assembly 12 in a clockwise direction will change the relative orientation of vibrator assembly 12 and mounting bracket 13 to approximately that shown in FIG. 3. At this point vibrator clamping strip 44 begins to contact the adjacent inner surface of mounting bracket collar assembly 56 and mounting bracket clamping strip 50 comes in contact with the adjacent outer surface of vibrator assembly 12. Initially, vibrator clamping strip 44 and mounting bracket clamping strip 50 are in contact with one another with the adjacent portion 51 of clamping strip 50 providing a stable support surface for clamping strip 44. In this position, vibrator assembly 12 is in contact with mounting bracket collar 56 at point "C". Following vibrator turn-on and the initial migratory rotation of vibrator assembly 12, three points of contact are established between vibrator assembly 12 and mounting bracket 13. These three points of contact are defined by vibrator clamping strip 44 and mounting bracket clamping strip 50 in contact with the facing adjacent surface of the opposing member and point "C" as shown in FIGS. 2–5.

The migratory, precessive movement of vibrator assembly 12 in a clockwise direction following vibrator turn-on causes vibrator assembly 12 to be wedged tightly within mounting bracket 13 as shown in FIG. 4. This migratory movement is in a direction opposite to the direction of rotation of the vibrating element in vibrator assembly 12. Vibrator assembly 12 is secured in mounting bracket 13 by the three aforementioned points of contact established by clamping strips 44, 50 and point "C" which also has been rotated in a clockwise direction in FIG. 4 from its position shown in FIG. 3. From FIGS. 2–4, it can be seen that the wedging effect of clamping strips 44 and 50 causes the longitudinal axes of vibrator assembly 12 and mounting bracket 13 respectively designated "A" and "B" to be displaced from one another and their relative orientation to change as vibrator assembly 12 is further rotated within mounting bracket 13. The migratory movement of vibrator assembly 12 causes clamping strips 44, 50 to continuously tighten on the adjacent, opposing surfaces of collar assembly 56 and vibrator assembly 12, respectively, resulting in an automatic and constant wedging, or tightening, action so long as the driving force is applied to the vibrator.

Figure 5:
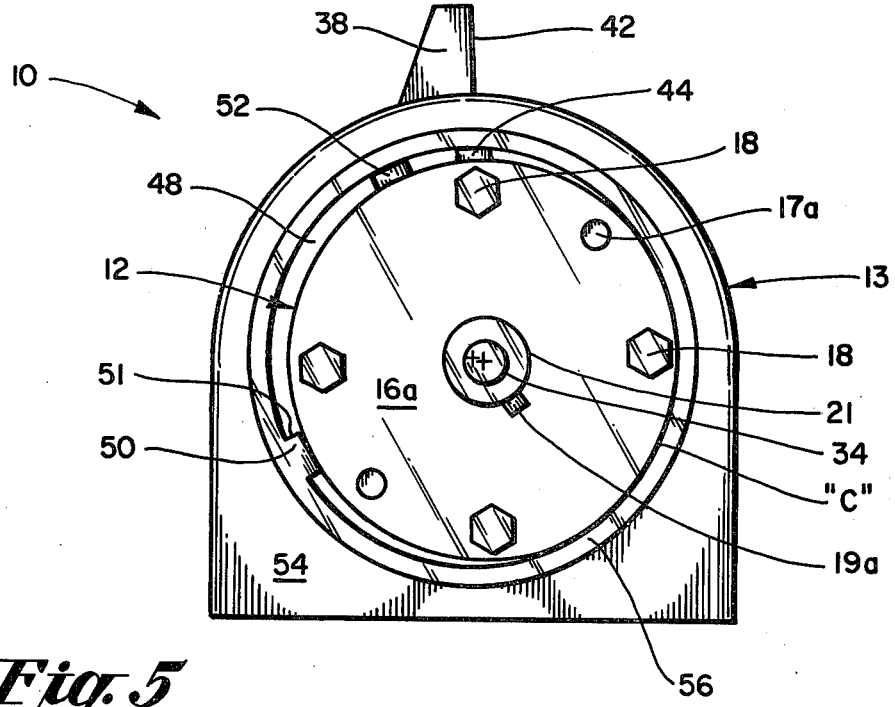
FIG. 5 is an end view of the self-clamping rotary vibrator and mount assembly showing the clamped vibrator assembly and mounting bracket combination wherein further vibrator rotation is limited by means of a stop strip.

FIG. 5 shows the self-clamping rotary vibrator and mount 10 in the fully-clamped position wherein a stop strip 52 securely attached to the outer surface of vibrator assembly 12 has been included. The purpose of stop strip 52 is to limit the clockwise, migratory rotation of vibrator assembly 12 so as to effect a reasonably secure engagement with mounting bracket 13, but not so tight as to require excessive force to disengage vibrator assembly 12 from mounting bracket 13. Strip 52 thus projects out from the surface of vibrator assembly 12 to a slightly greater extent than clamping strip 44 and limits the wedging interaction between the inner surface of collar assembly 56 and clamping strip 44.

Disengagement of vibrator assembly 12 from mounting bracket 13 is accomplished by striking surface 42 of knock-off lug 38 so as to rotate knock-off lug 38 and coupled vibrator assembly 12 in a counter-clockwise direction. This reverses the inclined plane effect of the earlier clockwise rotation of vibrator assembly 12 and allows the vibrator configuration to assume that of FIG. 2 wherein vibrator assembly 12 is loosely fitting within mounting bracket 13.

Finally, the compressed air which is provided via inlet fitting 36, which may be connected to either end cap, to the interior of vibrator shaft 28 is vented from vibrator assembly 12 by means of exhaust outlet 46, shown in FIG. 1. The vented gas which is still under high pressure enters the vibrator-mounting bracket interspace 48 and exits the self-clamping rotary vibrator 10 at either end of the vibrator. With exhaust outlet 46 positioned generally at the lengthwise center of vibrator body 14, the entire length of the vibrator-mounting bracket interspace 48 is kept clear of debris and contamination during operation of rotary vibrator 10 when the driving force is applied thereto. In addition, the expanding gas and moisture therein serve as a lubricant for the surfaces in interspace 48.

There has thus been described a self-clamping external rotary vibrator which is easily attached to and disengaged from a structure to be vibrated. The self-clamping action insures stable vibrator mounting with the compressed driving gas vented so as to avoid vibrator damage caused by debris lodging therein.

While particular embodiments of the present invention have been shown and described, it will be apparent to those skilled in the art that changes and modifications may be made therein without departing from the invention in its broader aspects. The aim of the appended claims, therefore, is to cover all such changes and modifications as fall within the true spirit and scope of the invention.

I claim:

1. A rotary vibrator energized by driving means coupled thereto and mounting assembly therefor comprising:

a rotor coupled to said driving means and displaced about an axis in response thereto;

a cylindrical housing having a circular cross-section encompassing and coupled to said rotor so as to rotate in a migratory manner about said axis in a direction opposite to that of said orbiting rotor, said housing including a first clamping strip thereon; and a cylindrical casing having a circular cross-section and adapted to be affixed to a structure to be vibrated and axially positioned with respect to said housing and in close proximity thereto, said casing including a second clamping strip wherein the migratory rotation of said housing causes the wedging engagement of said first and second clamping strips with the adjacent inner surface of said casing and adjacent outer surface of said housing, respectively, so as to form first and second points of contact defined by said first clamping strip and the inner surface of said casing and said second clamping strip and the outer surface of said housing, respectively, and a third point of contact distally located with respect to said first and second points of contact between said housing and said casing.

2. The combination of claim 1 wherein said driving means includes a source of gas under pressure for energizing said rotor and said housing includes an aperture in the outer surface thereof for venting said pressurized gas to the space between said housing and said casing.

3. The combination of claim 1 wherein said driving means is coupled to said rotor through a first end of said cylindrical housing, said combination further including lug means rigidly coupled to said first end of said cylindrical housing whereby said housing may be quickly detached from said casing by the rotation of said lug means in a direction opposite to the direction of rotation of said housing.

4. The combination of claim 1 wherein said first and second clamping strips and said third point of contact are approximately equally spaced about said axis of rotation when said housing and said casing are in wedged engagement.

5. The combination of claim 1 wherein said housing includes a stop strip extending further from the axis of rotation of said housing than said first clamping strip, said stop strip positioned between said first and second clamping strips when said housing and casing are in wedged engagement in limiting the rotation of said housing in said casing.

6. The combination of claim 1 wherein said first and second clamping strips extend substantially the entire lengths of said housing and casing, respectively.

7. The combination of claim 1 wherein said housing is initially loose fitting when positioned in said casing with the fit becoming increasingly tighter with the rotation of said housing by means of an inclined plane effect.

8. The combination of claim 3 wherein said driving means may be coupled to said rotor at either end of said cylindrical housing.

9. A rotary vibrator and mounting assembly therefor, said rotary vibrator energized by driving means including a source of gas under pressure, said rotary vibrator and mounting assembly comprising:

a rotor coupled to said driving means and displaced about an axis in response thereto;

a cylindrical housing having a circular cross-section encompassing and coupled to said rotor so as to rotate in a migratory manner about said axis in a direction opposite to that of said orbiting rotor, said housing including on its outer surface an aperture for venting said pressurized gas and a first clamping strip, with said driving means coupled to said rotor through a first end of said housing;

a cylindrical casing having a circular cross-section and adapted to be affixed to a structure to be vibrated and axially positioned with respect to said housing and in close proximity thereto, said casing including a second clamping strip wherein the migratory rotation of said housing causes the wedging engagement of said first and second clamping strips with the adjacent inner surface of said casing and adjacent outer surface of said housing, respectively, so as to form first and second points of contact defined by said first clamping strip and the inner surface of said casing and said second clamping strip and the outer surface of said housing, respectively, and a third point of contact distally located with respect to said first and second points of contact between said housing and said casing; and lug means rigidly coupled to said first end of said housing whereby said housing may be quickly detached from said casing by the rotation of said lug means in a direction opposite to the direction of rotation of said housing.

10. A rotary vibrator and mounting assembly therefor, said rotary vibrator energized by driving means including a source of gas under pressure coupled thereto, said rotary vibrator and mounting assembly comprising:

a rotor coupled to said driving means and displaced about an axis in response thereto;

a cylindrical housing having a circular cross-section encompassing and coupled to said rotor so as to rotate in a migratory manner about said axis in a direction opposite to that of said orbiting rotor, said housing including on its outer surface an aperture for venting said pressurized gas and first and second clamping strips, said second clamping strip extending further from the axis of rotation of said housing than said first clamping strip and positioned rearward of said first clamping strip with respect to the direction of rotation of said housing, with said driving means coupled to said rotor through a first end of said housing;

a cylindrical casing having a circular cross-section and adapted to be rigidly affixed to a structure to be vibrated and axially positioned with respect to said housing and in close proximity thereto, said casing including a third clamping strip wherein the migratory rotation of said housing causes the wedging engagement of said first and third clamping strips with the adjacent inner surface of said casing and adjacent outer surface of said housing, respectively, so as to form first and second points of contact defined by said first clamping strip and the inner surface of said casing and said third clamping strip and the outer surface of said housing, respectively, and a third point of contact distally located with respect to said first and second points of contact between said housing and said casing with the rotation of said housing in said casing limited by the engagement of said second clamping strip with the adjacent inner surface of said casing so as to form a fourth point of contact and wherein a continuous flow of pressurized gas is provided to the space between said housing and said casing through said aperture during rotor operation; and lug means rigidly coupled to said first end of said housing whereby said housing may be quickly detached from said casing by rotation of said lug means in a direction opposite to the direction of rotation of said housing.

11. A rotary vibrator and mounting assembly therefor, said rotary vibrator energized by driving means including a source of gas under pressure, said rotary vibrator and mounting assembly comprising:

a rotor coupled to said driving means and displaced about an axis in response thereto;

a cylindrical housing having a circular cross-section encompassing and coupled to said rotor so as to rotate in a migratory manner about said axis in a direction opposite to that of said orbiting rotor, said housing including on its outer surface an aperture for venting said pressurized gas and first and second clamping strips extending substantially the entire length of said housing, said second clamping strip projecting further from the axis of rotation of said housing than said first clamping strip and positioned rearward of said first clamping strip with respect to the direction of rotation of said housing, with said driving means coupled to said rotor through a first end of said housing;

a cylindrical casing having a circular cross-section and adapted to be rigidly affixed to a structure to be vibrated and axially positioned with respect to said housing and in close proximity thereto, said casing including a third clamping strip extending substantially the entire length of said casing, wherein the migratory rotation of said housing causes the wedging engagement of said first and third clamping strips with the adjacent inner surface of said casing and adjacent outer surface of said housing, respectively, so as to form first and second points of contact defined by said first clamping strip and the inner surface of said casing and said third clamping strip and the outer surface of said housing, respectively, and a third point of contact distally located with respect to said first and second points of contact between said housing and said casing with the three points of contact approximately equally spaced about said axis of rotation when said housing and said casing are in wedged engagement and wherein the rotation of said housing in said casing is limited by the engagement of said second clamping strip with the adjacent inner surface of said casing so as to form a fourth point of contact between said housing and said casing and wherein a continuous flow of pressurized gas is provided to the space between said housing and said casing through said aperture during rotor operation; and lug means rigidly coupled to said first end of said housing whereby said housing may be quickly detached from said casing by the rotation of said lug means in a direction opposite to the direction of rotation of said housing.

* * * * *